US008025179B2

(12) United States Patent
Miller et al.

(10) Patent No.: US 8,025,179 B2
(45) Date of Patent: Sep. 27, 2011

(54) CIRCUMFERENTIAL SLEEVE FOR HOLDING A FOOD CONTAINER UPRIGHT

(75) Inventors: David Miller, Frisco, TX (US); Matthew Phillips, Litchfield, CT (US); Matthew Prancuk, Brookfield, CT (US)

(73) Assignee: Frito-Lay North America, Inc., Plano, TX (US)

( * ) Notice: Subject to any disclaimer, the term of this patent is extended or adjusted under 35 U.S.C. 154(b) by 244 days.

(21) Appl. No.: 11/940,893

(22) Filed: Nov. 15, 2007

(65) Prior Publication Data

US 2009/0127273 A1 May 21, 2009

(51) Int. Cl.
*B65D 5/52* (2006.01)
*B65D 75/00* (2006.01)

(52) U.S. Cl. ..... 220/737; 220/62; 220/628; 220/630; 206/45.24; 206/784

(58) Field of Classification Search ..... 220/62, 220/628, 630, 737
See application file for complete search history.

(56) References Cited

U.S. PATENT DOCUMENTS

| | | | | | |
|---|---|---|---|---|---|
| 3,443,681 | A * | 5/1969 | Wysocki | ..... | 206/508 |
| 3,847,282 | A * | 11/1974 | Collura et al. | ..... | 206/782 |
| 4,944,603 | A * | 7/1990 | Cornish et al. | ..... | 383/5 |
| 4,962,849 | A * | 10/1990 | Anderson | ..... | 206/45.24 |
| 5,011,006 | A * | 4/1991 | Anderson | ..... | 206/45.24 |
| 5,123,527 | A | 6/1992 | Hustad | | |
| 5,540,381 | A * | 7/1996 | Davis | ..... | 229/103.2 |
| 5,888,565 | A * | 3/1999 | Gics | ..... | 426/124 |
| 5,900,263 | A | 5/1999 | Gics | | |
| 6,092,664 | A | 7/2000 | Bartosek | | |
| 6,568,585 | B2 * | 5/2003 | Marie | ..... | 229/103.2 |

* cited by examiner

*Primary Examiner* — Anthony Stashick
*Assistant Examiner* — Madison L Wright
(74) *Attorney, Agent, or Firm* — Colin P. Cahoon; Amanda K. Jenkins; Carstens & Cahoon, LLP

(57) ABSTRACT

One aspect of the present invention discloses a circumferential sleeve made from a single pre-cut blank with no additional material (other than adhesive) added to the blank. The circumferential sleeve has a strip that protrudes from the sleeve and one end of the strip is contiguous to a first portion sleeve such as the bottom edge and the other end of the strip is attached to a portion of the sleeve, such as the rear panel. The strip can be arcuate or L-shaped and permits a food container to stand upright.

12 Claims, 4 Drawing Sheets

CIRCUMFERENTIAL SLEEVE FOR HOLDING A FOOD CONTAINER UPRIGHT

BACKGROUND OF THE INVENTION

1. Technical Field

The present invention relates to displaying a container in the upright position, and, more particularly, the present invention provides a circumferential sleeve that can be placed around a food container to permit the container to stand upright.

2. Description of Related Art

Containers for food packages come in all shapes and sizes and almost always have some sort of product labeling to promote the food product in the container as well as to provide information regarding nutrition and ingredients. Many of the food containers used to store and promote the food to a consumer also can be used by a consumer as a dish, bowl, or tray. In such instance; a consumer can eat directly out of the food container. This is the case, for example, with trays or bowls which contain food items such as pudding, frozen foods, and dips. Dips, like other refrigerated products such as butter and sour cream, are available in round tub-like bowls made from plastic. Such containers and lids often have promotional material printed directly on the lid and on the side of the container or bowl. In the case of a tray, the promotional material is usually placed directly or indirectly (e.g., via an outer cardboard packaging) on the lid because the lid has the most exposed surface area for promotional material. Unfortunately, trays do not stand up well and bowls, if placed on their side so that the lid stock faces the consumer, can roll in the clockwise or counter clockwise direction, making it difficult to provide a neat, uniform display. Further, as the bowls rotate, the promotional graphics or lettering can be re-oriented, making it difficult for the consumer to read. Additionally, depending on the geometry of a bowl, it may not be able to stand up at all. For example, if a square-shaped bowl is tapered and the circumference of the bottom is much smaller than the circumference of the area adjacent to the lid, the bowl will not be able to stand upright. Consequently, a need exists for a container that can stand upright on a supermarket shelf to allow consumers to easily see the promotional materials for that product.

FIG. 1 is a rear-perspective view of a prior art package comprising a collar 16 around a container 20 wherein the collar has a tab 10 extended outward from the collar to permit the tray to stand upright. Similar designs are shown in U.S. Pat. Nos. 5,900,263 and 5,123,527. One problem with the tabs 10 like those depicted in FIG. 1 is that it is relatively easy for a crease 12 to form in the area depicted by numeral 12. Any type of downward pressure placed on the container or the collar, for example, can promote formation of such a crease 12. Further, because the tab 10 extends outward and terminates outside the collar 16, the tab 10 is subject to catch on objects during transport and shipping, further promoting crease 12 formation. Because the collar 16 is typically made of cardboard-type material, minimal pressure on the tab 10 can result in a crease 12. Once a crease 12 is formed, the integrity of the tab 10 is substantially compromised and it is more difficult to make the container 20 stand upright. Further, if the container 20 is stored in refrigerated conditions, condensation can occur which can further weaken the integrity of the tab 10 at the crease 12. Consequently, a need exists for an improved circumferential sleeve for holding a food container in the upright position that is less affected by condensation and is less likely to be prone to failure.

SUMMARY OF THE INVENTION

The present invention is directed towards a circumferential sleeve for holding a container upright. In one aspect, the circumferential sleeve comprises a strip defined by a first side and a second that is separated from the circumferential sleeve. In one aspect, the strip comprises a first end that is contiguous with a first portion of the circumferential sleeve and a second end that is attached to a second portion of the sleeve. In one aspect, the strip provides a sturdy foot that protrudes from the sleeve to permit round, tapered, or containers having lips to stand upright when placed in the circumferential sleeve of the present invention. The above, as well as additional features and advantages of the present invention will become apparent in the following written detailed description.

BRIEF DESCRIPTION OF THE DRAWINGS

The novel features believed characteristic of the invention are set forth in the appended claims. The invention itself however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
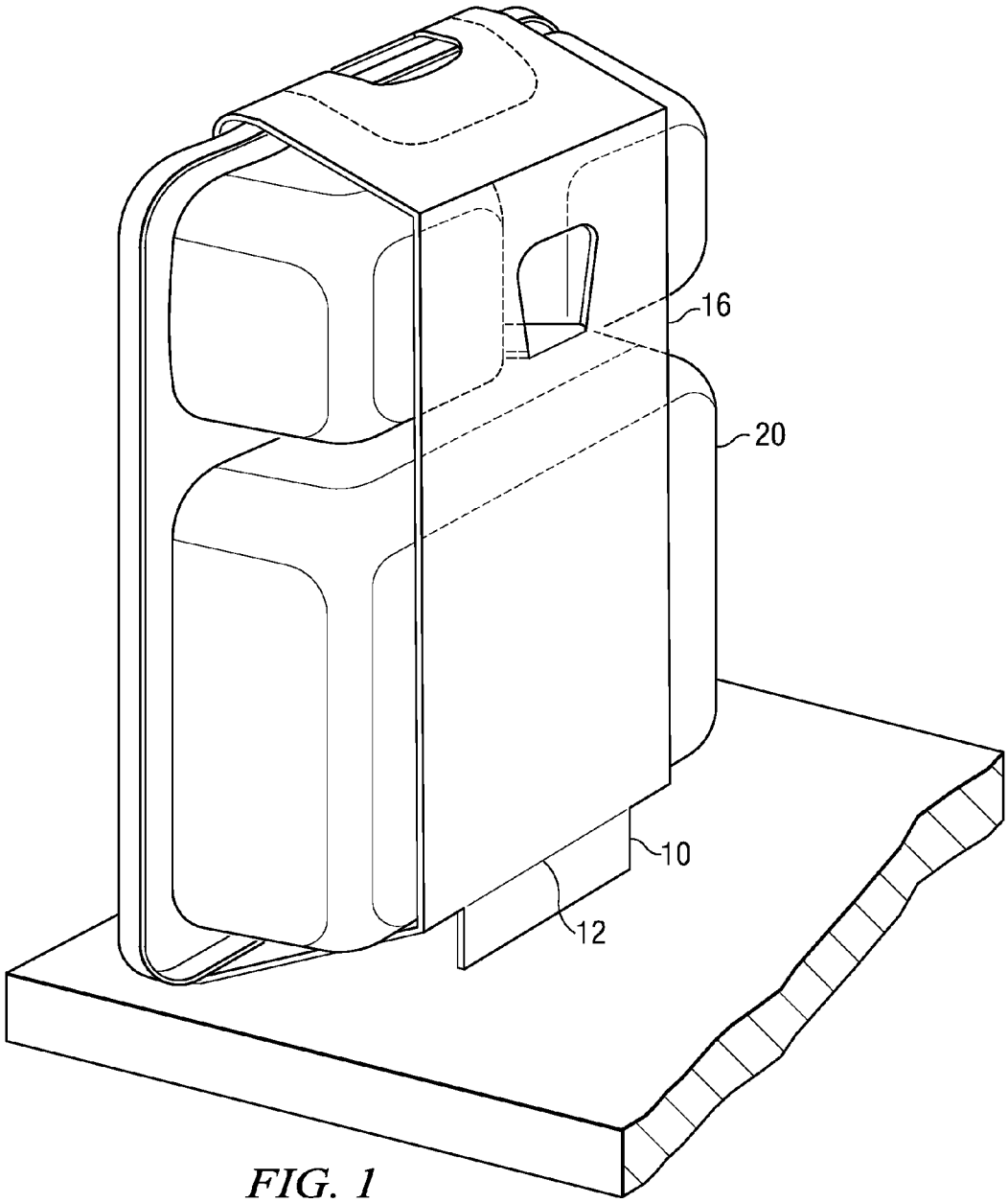
FIG. 1 (PRIOR ART)
FIG. 1 is a rear-perspective view of a prior art package and collar.
Figure 2:
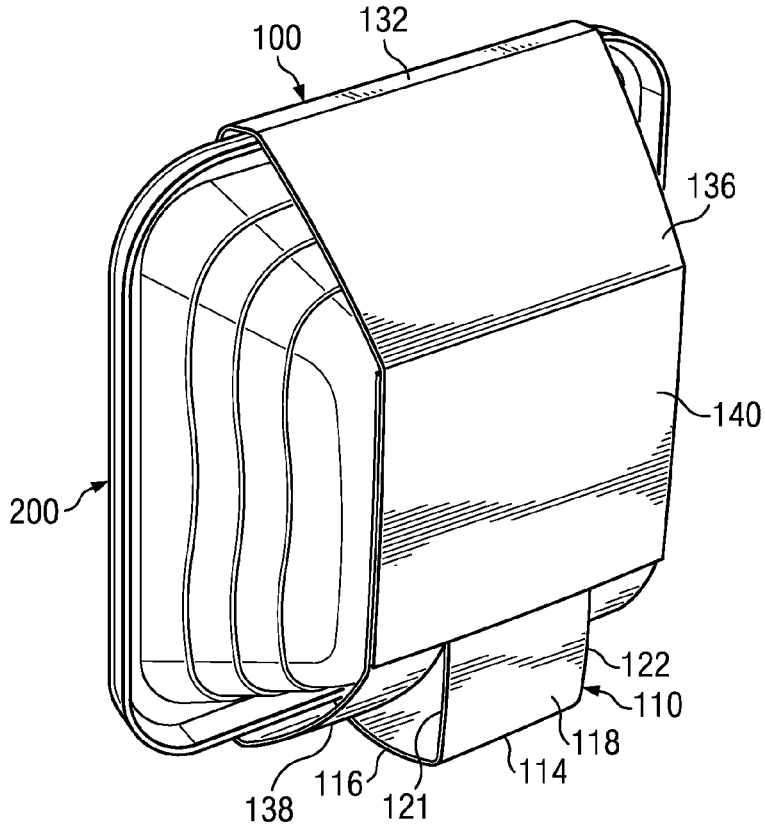
FIG. 2 is a rear-perspective view of a food container in a circumferential sleeve in accordance with one embodiment of the present invention.
Figure 3:
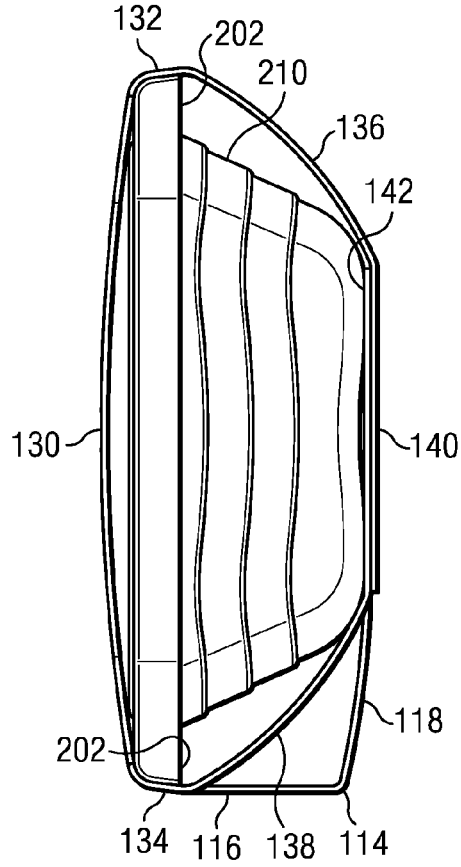
FIG. 3 is a side view of a food container inside a circumferential sleeve depicted in FIG. 2.
Figure 4:
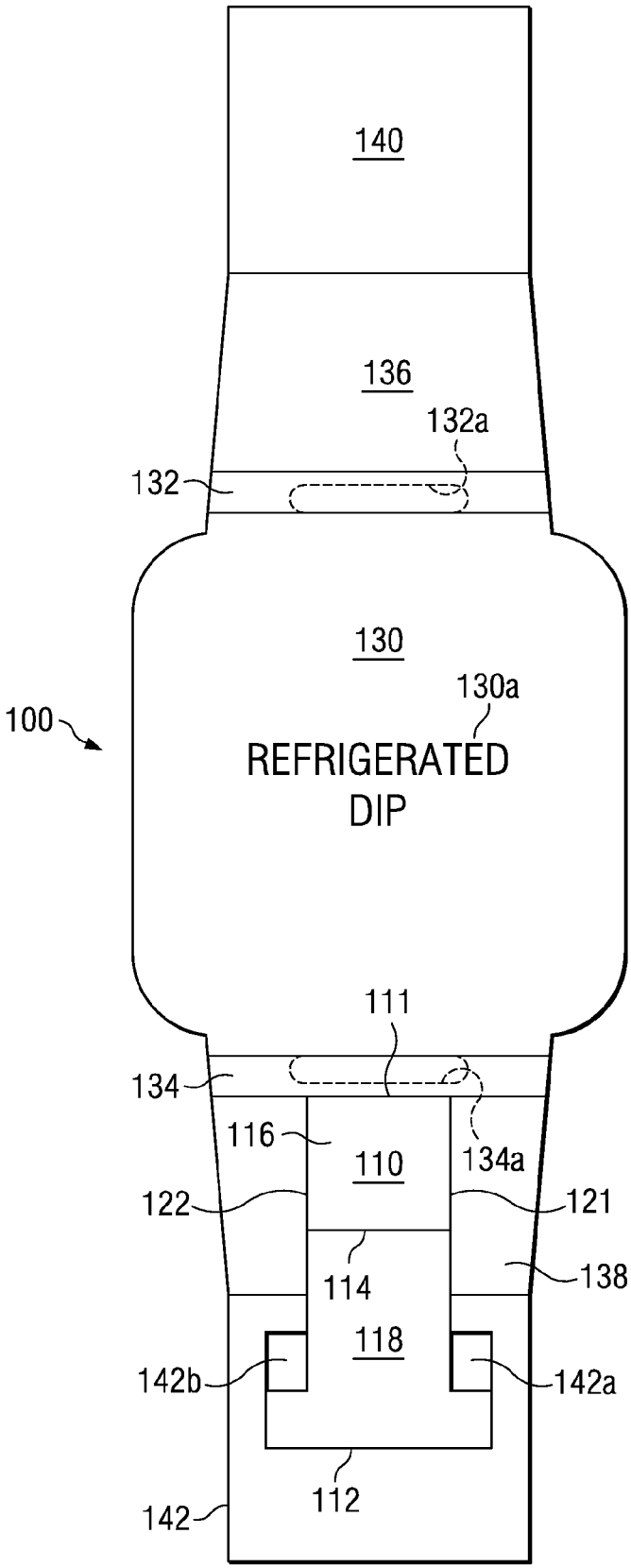
FIG. 4 is a top view of the blank that forms the circumferential sleeve in accordance with one embodiment of the present invention.

FIG. 2 is a rear-perspective view of a food container 200 in a circumferential sleeve 100 in accordance with one embodiment of the present invention. FIG. 3 is a side view of a food container inside a circumferential sleeve 100 depicted in FIG. 2. Like numerals represent like elements throughout the specification. Referring to FIG. 2 and FIG. 3, the circumferential sleeve 100 for holding a food container 200 upright comprises a strip 110 having a first side 121 and a second side 122. The first side 121 and second side 122 of the strip 110 are separated by cuts in the lower panel 138 and the back panel 142 (as best shown by FIG. 4). The separation of the first side 121 and second side 122 permits the strip 110 to protrude outwardly from the lower panel 138. In one embodiment, the strip 110 comprises a fold 114 which extends from the first side 121 to the second side 122. Such fold 114 can permit the strip 110 to be substantially L-shaped. In such embodiment, the L-shaped strip 110 comprises a base member 116 and an upright member 118 separated by said fold 114. In one embodiment, no such fold exists and the strip 110 is arcuate.

In one embodiment, the circumferential sleeve 100 comprises a front panel 130 adjacent to both a top edge 132 and a bottom edge 134. The top edge 132 and bottom edge 134 can be sized to fit over the lip 202 of the container 200 when the container is placed in the sleeve 100. The top edge 132 can be adjacent to an upper panel 136 and the bottom edge 134 can be adjacent to a lower panel 138. In one embodiment, a rear panel 140 and a back panel 142 are fastened via glue, tape, or other suitable means to each other and are situated between the upper panel 136 and lower panel 138.

One advantage of the circumferential sleeve 100 depicted is that food containers 200 having tapered sides can be placed into the circumferential sleeve 100 so that promotional material on the front panel 130 can be viewed by consumers. Because the front panel 130 has the largest surface area, it is more conducive to providing promotional material in a size that can be easily read by a consumer.

FIG. 4 is a top view of the blank that makes the circumferential sleeve in accordance with one embodiment of the present invention. As shown, the blank that forms the circumferential sleeve 100 comprises a front panel 130 having promotional graphics 130*a* bounded by the portion which will become the top edge 132 on one side and the portion which will become the bottom edge 134 on the opposite side of the front panel 130. Adjacent the top edge 132 is the upper panel 136 followed by the rear panel 140. The top edge 132 optionally has a slot 132*a*. Similarly the bottom edge 134 optionally comprises a slot 134*a*. Adjacent to the bottom edge 134 is a lower panel 138 and the strip 110.

Figure 5:
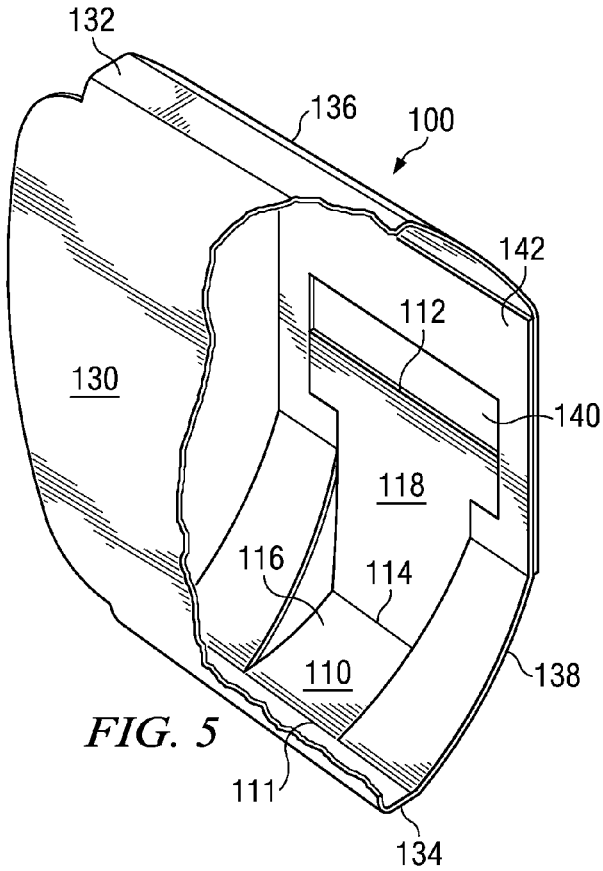
FIG. 5 is a front cutaway perspective view of the circumferential sleeve without a container in accordance with one embodiment of the present invention.

FIG. 5 is a front cutaway perspective view of the circumferential sleeve 100 without a container in accordance with one embodiment of the present invention. Referring to FIG. 4 and FIG. 5, the strip 110 comprises a first end 111 contiguous to the circumferential sleeve 100 and, as shown; the strip 110 is contiguous to the bottom edge 134 of the circumferential sleeve 100. Of course, such embodiment is provided for purposes of illustration and not limitation. The first end 111 can be contiguous with portions of the circumferential sleeve 100, including the rear panel 138 and the front panel 130.

In the embodiment depicted in FIGS. 4 and 5, the strip 110 is separated from the rear panel 138 at first side 121 and second side 122 of the strip 110. The strip is also separated from the back panel 142 at the second end 112. In other embodiments, the separation of the second end 112 can be from the lower panel 138 or the top panel 136.

Referring back to FIG. 4, in one embodiment, notches 142*a* and 142*b* are cut out of the back panel 142 to result in the strip 110 having a substantially T-shaped second end 112. The second end 112 can then be moved towards the notches 142*a*, 142*b* and secured into place to permit the strip 110 to protrude from the lower panel 138 of the circumferential sleeve 100. In one embodiment as best depicted by FIG. 5, the second end 112 of the strip 110 and the back panel 142 are each secured by glue or other suitable means to the rear panel 140 after the T-shaped second end 112 has been moved into the area formed by the notches 142*a* 142*b* (shown in FIG. 4) such that the strip 110 protrudes from the circumferential sleeve 100.

Figure 6:
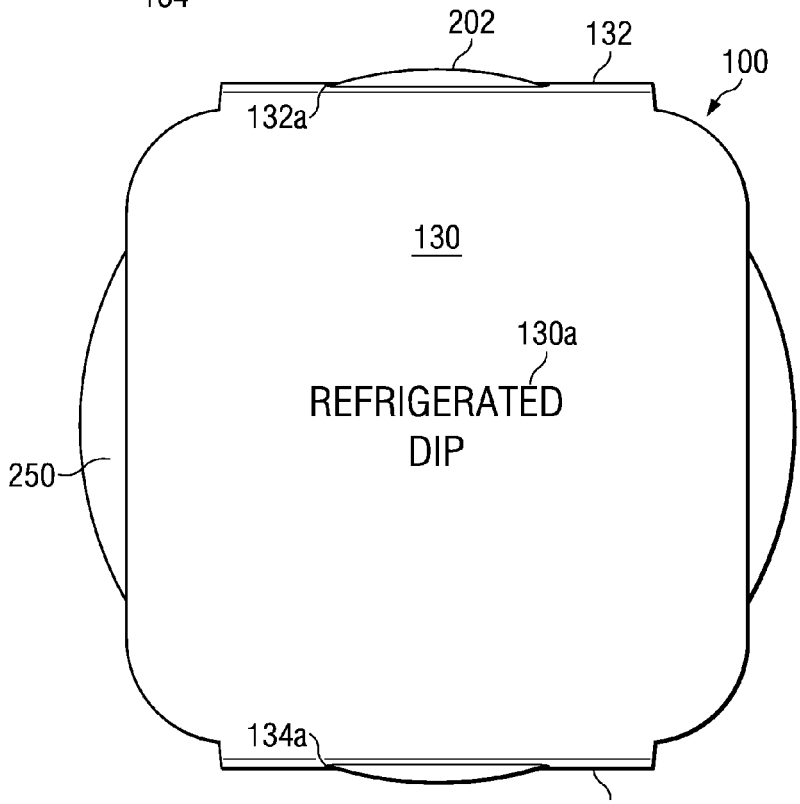
FIG. 6 is a front view of a circumferential sleeve encompassing a round container in accordance with one embodiment of the present invention.

FIG. 6 is a front view of a circumferential sleeve 100 encompassing a round container 250 in accordance with one embodiment of the present invention. As shown by FIG. 4, in one embodiment, the circumferential sleeve 100 comprises a top slot 132*a* and a bottom slot 134*a*. The slots 132*a* 134*a* are sized such that the lip 202 of the round container 210 can protrude through the slots 132*a* 134*a*. One advantage of such a circumferential sleeve 100 is that a round food container 250 can be made to stand upright in the circumferential sleeve 100. Further, the circumferential sleeve 100 can help lock the container 200 into place so that the round food container 250 does not roll around when displayed on a shelf. Consequently, one embodiment of the present invention permits a way to neatly display round tapered or untapered tub-like containers. Moreover, because the graphics 130*a* are on the front panel 130 of the circumferential sleeve 100 the graphics 130*a* are always oriented in the proper direction. Consequently, the round container 200 can be placed in any orientation within the circumferential sleeve 100 knowing that the graphics 130*a* are properly oriented.

There are several other advantages conferred by various embodiments of the present invention. In one aspect, the present invention permits a way to stand up a tapered or untapered container having a protruding lip. Bowls having a tapered design wherein the bottom of the bowl has a diameter less than the diameter of the top of the bowl can be stood upright when placed in the circumferential sleeve of the present invention. Further, the sleeve 100 of the present invention can be used more effectively than prior art sleeves because the protruding strip 110 is much sturdier than the stand-up tabs of the prior art because the strip 110 does not terminate outside the sleeve 100. Consequently, there are no ends that can get snagged and it is less likely to crease near the rear 140 or back panels 142. Moreover, because of the design of the protruding strip 110 of the present invention, the present invention can be advantageously used for food containers displayed in refrigerators or freezers in grocery stores because the strip of the present invention is less susceptible to weakening due to condensate. Further, the present invention provides a way to display circular bowls in an upright manner without the worry that the bowls will roll while on the shelf and with confidence and knowledge that the lettering for other promotional graphics will be oriented in the proper direction. The present invention can be efficiently made from a single blank of cardboard, paper, or other suitable material with no added material. Consequently, the present invention provides a circumferential sleeve made from a simple die-cut design.

The present invention also permits marketing of containers having no graphical material. For example, because the containers can be removed from the circumferential sleeve by the consumer when the consumer has purchased the product, the container itself can be reused by the consumer and the container can appear to have been purchased by the consumer as a container, rather than recycled from a tub of butter, dip, or other food product.

Further, containers more elegant in design can be made and sold to consumers or caterers who can place the containers out directly for consumption without placing the food product into another serving dish. For example, of the person or company is having a dinner party, a consumer can purchase a pre-made dip in a container held in a circumferential sleeve 100 of the present invention and the consumer can discard the sleeve 100, placing the unmarked container out for people to use to retrieve their dip without the need for transferring the dip into an unmarked dish for a more elegant appearance than can be achieved with promotional material displayed.

While this invention has been particularly shown and described the preference to the preferred embodiment, it will be understood by those skilled in the art that changes in form and detail may be made therein without departing from the spirit and scope of the invention. For example, although the strip 110 is depicted as being contiguous with the bottom edge 134 in the Figures, in one embodiment, the first end 111 strip can be contiguous with a back panel 142, and the second end 112 can be attached to the front panel 130 or the bottom edge 134.

We claim:

1. A circumferential sleeve (100) for holding a food container upright, said circumferential sleeve (100) comprising:

a strip (110) having:

a first end (111) and a second end (112), wherein said first end (111) is contiguous with a first portion said sleeve (100) and the second end (112) is attached to a second portion of said sleeve after being detached from a back panel (142) along each edge of said second end (112);

a first side (121) and a second side (122), wherein said first side (121) and said second side (122) are separated from said sleeve (100), wherein said strip (110) protrudes from said sleeve (100) and wherein said sleeve (100) is in a formed, enclosed position.

2. The circumferential sleeve (100) of claim 1 wherein said first portion comprises a bottom edge (134).

3. The circumferential sleeve (100) of claim 1 wherein said second portion comprises a rear panel (140).

4. The circumferential sleeve (100) of claim 1 wherein said sleeve (100) is made from a single pre-cut blank.

5. The circumferential sleeve (100) of claim 1 wherein said strip (110) is integral to said circumferential sleeve.

6. The circumferential sleeve (100) of claim 1 wherein said strip (110) comprises a fold line (114) extending from said first side (121) to said second side (122).

7. The circumferential sleeve (100) of claim 1 further comprising one or more slots at a top edge (132) or bottom edge (134).

8. The circumferential sleeve (100) of claim 7 wherein each of said slots is adapted to lock a round food container into place.

9. The circumferential sleeve (100) of claim 1 wherein said food container (200) comprises a single tapered well (210).

10. The circumferential sleeve (100) of claim 1 further comprising a container, wherein said container is an unmarked container.

11. The circumferential sleeve (100) of claim 1 further comprising a top edge (132) and a bottom edge (134) and a container (200) having a lip, wherein said lip of said container resides between said top edge (132) and said bottom edge (134).

12. The circumferential sleeve (100) of claim 1 wherein said strip (110) is substantially L-shaped.

* * * * *